US005964035A

United States Patent [19]

Poehlmann

[11] Patent Number: 5,964,035

[45] Date of Patent: Oct. 12, 1999

[54] FOLDING KNIFE

[76] Inventor: Paul W. Poehlmann, 1590 Hyacinthe Bay Rd., Quadra Island, Canada, V0P 1H0

[21] Appl. No.: 08/837,717

[22] Filed: Apr. 22, 1997

Related U.S. Application Data

[63] Continuation of application No. 08/372,185, Jan. 13, 1995, abandoned.

[51] Int. Cl.[6] ..... B26B 1/04

[52] U.S. Cl. ..... 30/161; 30/155

[58] Field of Search ..... 30/151, 155, 156, 30/158, 159, 160, 161

[56] References Cited

U.S. PATENT DOCUMENTS

| | | | |
|---|---|---|---|
| D. 252,182 | 6/1979 | Poehlmann | D8/99 |
| D. 256,427 | 8/1980 | Lile | D8/99 |
| D. 256,982 | 9/1980 | Sakurai | D8/99 |
| D. 310,621 | 9/1990 | Thompson | D8/99 |
| D. 348,818 | 7/1994 | Hasegawa | D8/99 |
| 400,987 | 4/1889 | Wilzin | 30/159 |
| 492,084 | 2/1893 | Brigham | 30/159 |
| 603,847 | 5/1898 | Harvey | 30/161 |
| 1,647,405 | 11/1927 | Giesen | 30/160 |
| 1,701,027 | 2/1929 | Brown | 30/159 |
| 2,286,524 | 6/1942 | Wilbur | 30/161 |
| 2,530,236 | 11/1950 | Erickson | 30/159 |
| 3,783,509 | 1/1974 | Lake | 30/161 |
| 3,942,249 | 3/1976 | Poehlmann | 30/160 |
| 4,170,061 | 10/1979 | Henry | 30/160 |
| 4,233,737 | 11/1980 | Poehlmann | 30/335 |
| 4,272,887 | 6/1981 | Poehlmann | 30/161 |
| 4,404,748 | 9/1983 | Wiethoff | 30/161 |
| 4,451,982 | 6/1984 | Collins | 30/161 |
| 4,541,175 | 9/1985 | Boyd et al. | 30/161 |
| 4,765,206 | 8/1988 | Poehlmann | 81/3.37 |
| 4,893,409 | 1/1990 | Poehlmann | 30/161 |
| 4,979,301 | 12/1990 | Walker | 30/161 |
| 4,985,998 | 1/1991 | Howard | 30/158 |
| 5,092,045 | 3/1992 | Boyd, Jr. et al. | 30/161 |
| 5,111,581 | 5/1992 | Collins | 30/161 |
| 5,327,651 | 7/1994 | Favreau | 30/161 |

FOREIGN PATENT DOCUMENTS

| | | | |
|---|---|---|---|
| 549428 | 11/1942 | United Kingdom | 30/160 |

OTHER PUBLICATIONS

Quicksilver advertisement, The Edge Company Store Catalog, 1992, p. 2.

Timberline advertisement, Blade Magazine, Jul./Aug. 1988, p. 16.

*Primary Examiner*—Hwei-Siu Payer

*Attorney, Agent, or Firm*—Patrick M. Dwyer

[57] ABSTRACT

A knife having a blade rotatably coupled to a handle and lockable in an extended or a folded configuration is provided. A device for locking the extended blade against clockwise rotation and a separate device for locking the extended blade against counterclockwise rotation are provided. In one embodiment, one of these mechanisms is a key and keyway device and the other of these mechanisms is an adjustable stop device, preferably adjustable by a set screw.

18 Claims, 6 Drawing Sheets

FOLDING KNIFE

This application is a continuation of Ser. No. 08/372,185 filed Jan. 13, 1995 entitled FOLDING KNIFE, by Paul W. Poehlmann now abandoned

BACKGROUND INFORMATION

A number of folding knife configurations have been used in the past. FIG. 1 depicts a knife generally of the type described in U.S. Pat. No. 3,942,249 issued Mar. 9, 1976 to Mr. Paul W. Poehlmann. In this device, a handle is formed by left and right side plates, 1007, 1008 sandwiching a spacer 1009 and held together by rivets 1011 and 1012. A blade 1041 is coupled to the handle so as to be rotatable about axis 1018 from the extended configuration depicted in FIG. 1 to a folded configuration with the blade 1041 adjacent the spacer 1009 and substantially between the sideplates 1007 and 1008. A key locking mechanism made up of hub 1021, spring 1056, detent 1048 and nut 1036 resides in openings 1016, 1043, 1029 in the left plate 1007, blade 1041 and right plate 1008 respectively. Keys 1052, 1053 interact with keyways 1044, 1046, 1038, 1039 in the blade 1041 and right plate 1008 respectively. In the normal configuration, the key locking mechanism is configured so that the keys 1052, 1053 reside partially in the blade keyways 1044, 1046 partially in the plate keyways, 1038, 1039. Thus locking the blades 1041 in a position with respect to the handle. When the user pushes on the activation surface of the key locking mechanism, (e.g. depressing right surface of the detent 1048) the keys 1052, 1053 are moved, against the urging of spring 1056 so as to reside solely within the blade keyways 1044, 1046 and to be clear of the plate keyways 1038 and 1039. With the activation surface so depressed, the key locking mechanism can be rotated, carrying the blade 1041 with it and rotating the blade 1041, e.g., from the extended configuration to the folded configuration or vice-versa. After such rotation, once the detents 1053, 1052 are aligned with the plate keyways 1038, 1039 the spring 1056 will urge the key device back into the relaxed configuration such that the keys 1053 1052 reside partially in the blade keyways 1044 1046 and partially in the plate keyways 1038, 1039 thus locking the blade in the folded configuration.

Although the configuration shown in FIG. 1 has proved to be useful and desirable for a multitude of purposes, it can be difficult and/or expensive to produce the device with sufficient accuracy e.g. to achieve a desired degree of locking of the blade with no play. In most cases, using normal manufacturing tolerances, a knife which is configured with tolerances to permit the detents 1052, 1053 to slide easily in the keyways 1044, 1046, 1038, 1039 may often result in a locked configuration which has an undesirable amount of play, i.e., in which the blade 1041 can rotate a small amount with respect to the handle, even in the locked position. Furthermore, the configuration depicted in FIG. 1 is such that the blade in the extended position is exactly 180° rotationally displaced from the blade in the closed or folded configuration, which places undesirable constraints on the knife design and restricts the perimeter design of the blade. In knives which provide for the meeting of stop surfaces, some geometries caused undesirable movement of forces on components, upon such meeting, because of a resultant camming action of the respective parts. Furthermore, in the embodiment of FIG. 1, there may be an undesirable amount of blade play in the extended position.

Accordingly, it would be useful to provide a folding knife which provides for secure locking in the extended and folded configuration with minimum play, which permits locking after a rotational blade displacement of other than 180°, preferably less than 180° and/or which has improved ease or economy of design, manufacture, repair and/or maintenance.

SUMMARY OF THE INVENTION

According to the present invention, the blade is held in a locked configuration by the combination of the interaction of a key and keyway and the abutment of a stop surface coupled to or formed in the handle with a corresponding surface coupled to or formed in the blade. Preferably at least one of the stop surfaces is adjustable, e.g. via a set-screw mechanism. In one embodiment, the interaction of a key and keyway act to lock the blade against rotation in a first rotational direction while the interaction of the stop surfaces act to lock the blade against rotation in the opposite rotational direction. Preferably the extended position of the blade is rotationally displaced from the folded position of the blade by an angle which is different from and preferably less than, 180° such as by providing keyway contact surfaces or key contact surfaces which are non-parallel with each other. In one embodiment, more than two key surfaces contact corresponding keyway surfaces when the blade is in the locked configuration.

DETAILED DESCRIPTION OF THE PREFERRED EMBODIMENTS

Figure 2:
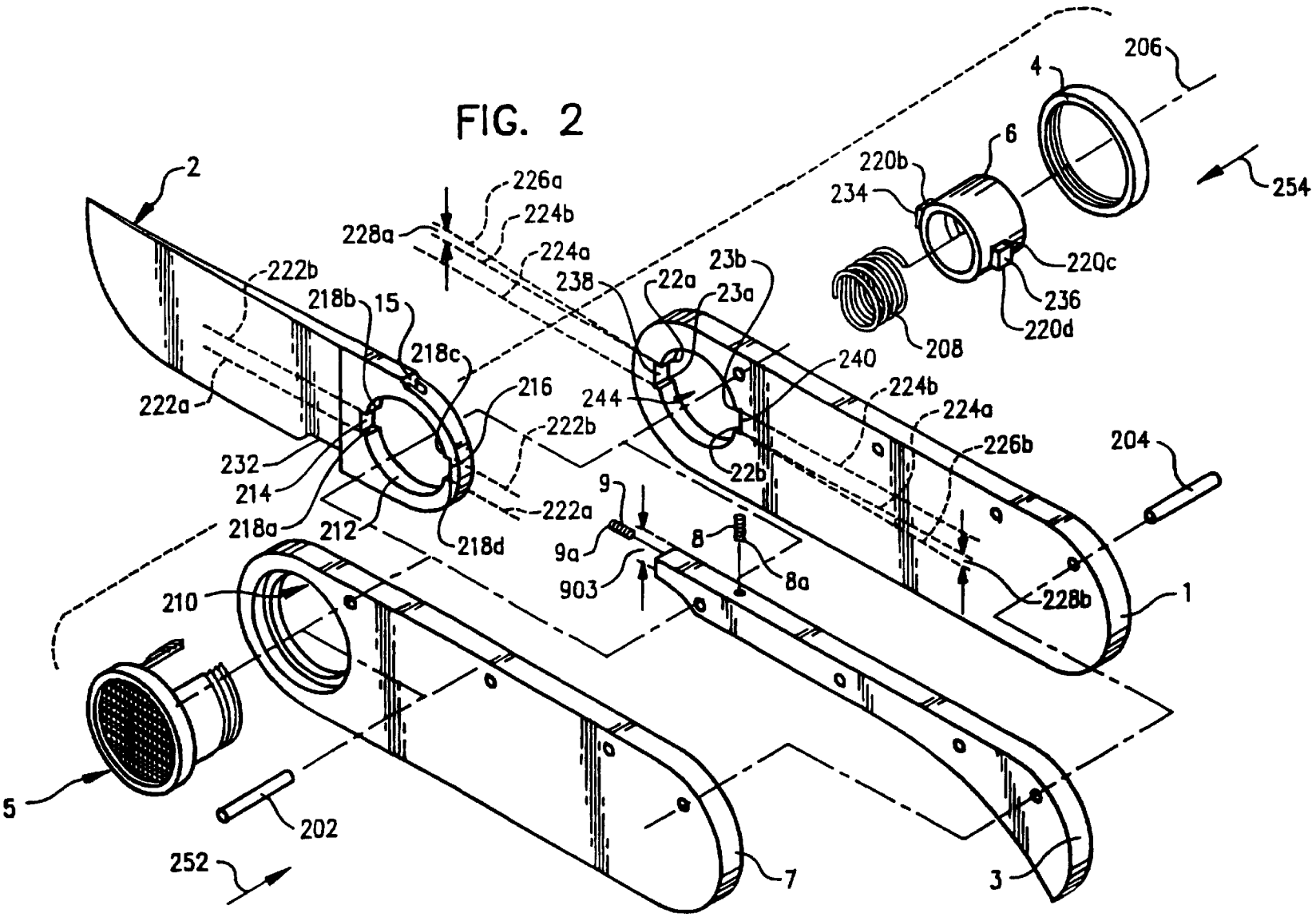
FIG. 2 is an exploded perspective view of a knife according to one embodiment of the present invention.
Figure 3:
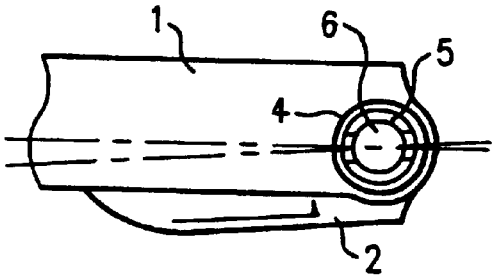
FIG. 3 is a schematic right side elevational view of a knife according to one embodiment of the present invention with the blade in a folded configuration.
Figure 4:
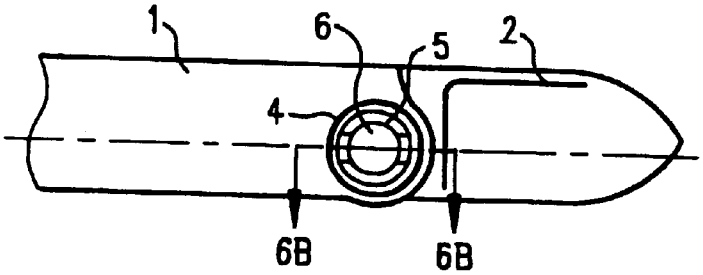
FIG. 4 is a right side elevational view of the knife of FIG. 3 with the blade in the extended configuration.

As depicted in FIG. 2, in one embodiment a handle formed of right plate 1, left plate 7 and spacer 3 is held together by fastening devices such as rivets 202, 204. A blade 2 is mounted to the handle so as to permit rotation about axis 206 from the folded configuration depicted in FIG. 3 to the extended configuration depicted in FIG. 4. The axis 206 is defined by a key locking mechanism including a carrier 5, a spring 208, key device 6 and nut 4. Openings and keyways 210, 212, 244 in the left plate 7, blade 2 and right plate 1 respectively define a space for accommodating the key locking mechanism.

Figure 1:
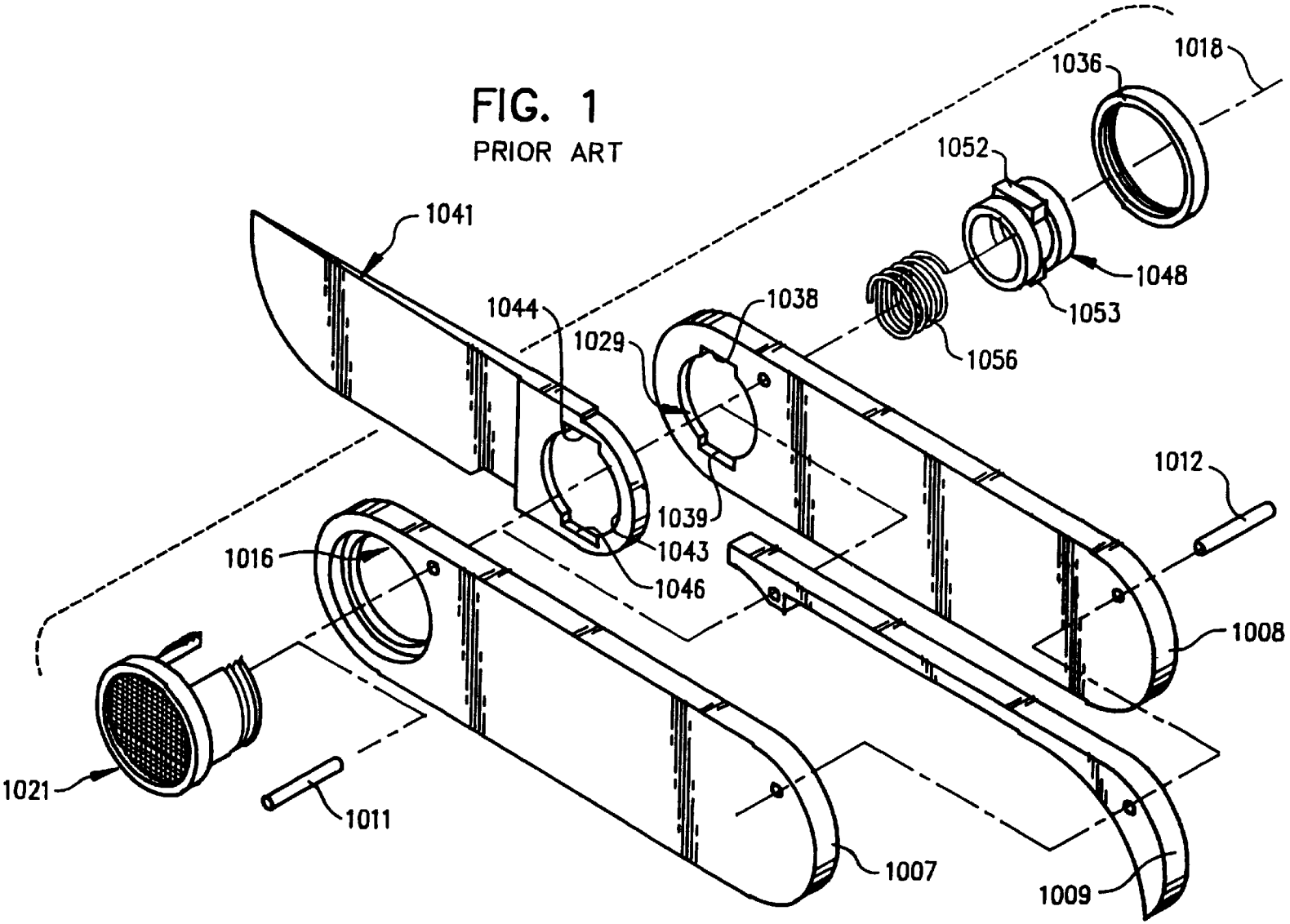
FIG. 1 PRIOR ART
FIG. 1 is an exploded perspective view of a folding knife of previous configuration.

In the embodiment of FIG. 2, first and second keyways 214, 216 are formed in the surface of opening 212 defining blade keyway contact surfaces 218*a*, 218*b*, 218*c*, 218*d* which, during operation and/or locking, contact corresponding key contact surfaces 220*a* (not shown) 220*b*, 220*c*, 220*d* as described below. In the depicted embodiment, blade keyway contact surfaces 218*a*, 218*d* lie along a first plane 222*a* and blade keyway contact surfaces 218*b*, 218*c* lie along a second plane 222*b* substantially parallel with the first plane 222*a*. In the embodiment of FIG. 2, the axis defined by the keys is substantially parallel to the longitudinal axis of the knife, so that blade play that may arise from e.g. key-keyway clearances will be substantially along the longitudinal knife axis, which is preferable to blade play along a perpendicular axis of the type that may arise in the configuration shown in FIG. 1.

Right plate opening 244 also defines keyways having keyway contact surfaces 22*a*, 22*b*, 23*a*, 23*b*. In the depicted embodiment, contact surfaces 23*a*, 23*b* lie on planes 224*a*, 224*b* and right plate keyway contact surfaces 22*a*, 22*b* lie along planes 226*a*, 226*b*. In the depicted embodiment, right plate keyway contact surface 22*a* is not parallel with surface 23*a*, but, rather, lies in a plane 226*a* which is at a first angle 228*a* with respect to plane 224*b*. Similarly, right plate keyway contact surface 22*b* lies in a plane 226*b* which is at an angle 228*b* with respect to plane 224*a*. This configuration can be seen in FIG. 5. In the depicted embodiment angles 228*a* and 228*b* are substantially the same. The value of the angles 228*a*, and 228*b* will affect, among other things, the amount of angular rotation of the blade between the embodiment of FIG. 3 (folded configuration) and FIG. 4 (extended configuration). In one embodiment, angles 228*a*, 228*b* are less than about 15°, to provide for blade travel from the open to the closed configuration through an angle between about 165 degrees and about 180 degrees.

Returning to FIG. 2, a first stop device 9 coupled to the handle, and specifically to the spacer 3 interacts with a stop surface 15 of the blade to partially define an open or extended configuration of the blade as described below. A second stop device 8 interacts with a second blade stop surface 232 to partially define a blade position for the closed configuration depicted in FIG. 3. Preferably the set device 9 is adjustable to that the location of the contact surface 9*a* of stop device 9 can be moved or adjusted. In one embodiment, stop device 9 is a set screw which can be rotated in a screw-like fashion to adjust its contact surface 9*a* so as to bear against blade stop surface 15 when the blade 2 is in the desired extended position. Similarly, stop device 8 is preferably adjustable, e.g. by being a set screw such that its contact surface 8*a* can be adjusted to a location such that is bears against blade stop surface 232 when the knife is in the folded configuration shown in FIG. 3, as described more fully below. Preferably, the contact surfaces of the stop devices 8 and 9 are perpendicular to the respective contact faces 15 and 232. Although other, non-perpendicular configuration would be at least partially operable, it is believed that the perpendicular configuration provides the most positive and lasting adjustment.

When the key locking mechanism is in the relaxed configuration the spring 208, partially compressed between the carrier 5 and the key 6, positions the key along axis 206 in a location such that the first and second key devices 234, 236 are positioned partially in the keyways 238, 240 of the right plate 1 and partially in the keyways 214, 216 of the blade 2

Figure 5:
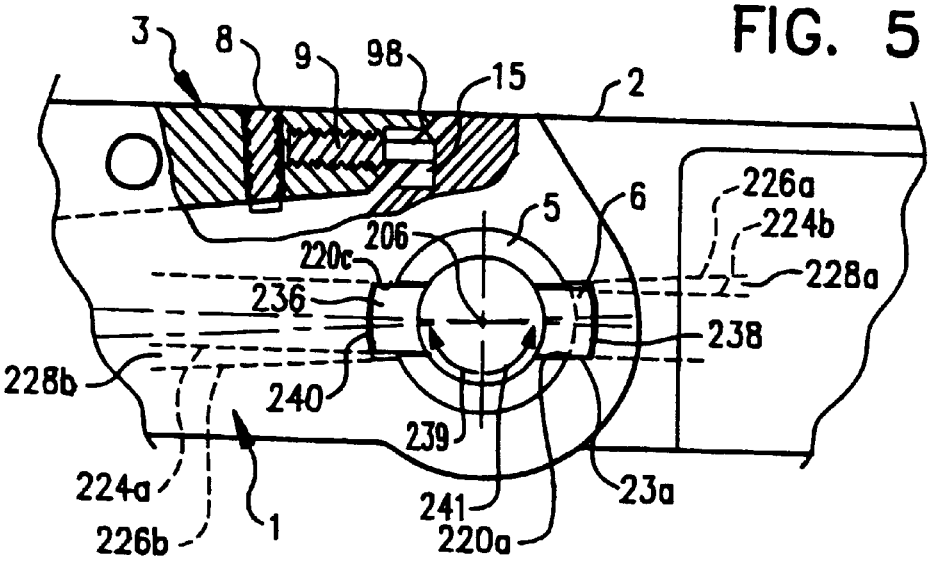
FIG. 5 is a partial right side elevational view, partially cut away, of the knife FIG. 4 with the nut removed.

As shown on FIG. 5, when the knife is in the open configuration, key contact surface 220*a* contacts keyway surface 23*a* and key contact surface 220*c* contacts right plate keyway contact surface 23*b*. The abutment of contact surfaces 220*a* with 23*a* and 220*c* with 23*b* thus prevents the key 6 from rotating clockwise 239 with respect to the right plate 1. The view of FIG. 7 (corresponding to the view of FIG. 5 but with the right plate 1 removed) shows that the key devices 234, 236 of the key 6 are positional, with relatively close clearance 17, to the keyway 214, 216 of the blade and thus rotation of the key 6 with respect to the blade 2 is substantially prevented. The amount of clearance 17 which is provided will depend on the particular configuration. In one embodiment the clearance 17 is between about 0.0005 inches (about 0.01 millimeters) and about .0015 inches about (0.04 millimeters). Thus, since the key 6 in the relaxed or locked configuration is prevented from clockwise rotation 239 with respect to the plate 1 and is prevented from any rotation with respect to the blade 2, the effect is that the intersection of contact surfaces 220*a*, 220*c* with keyway surfaces 23*a*, 23*b* prevents substantially any clockwise rotation of the blade 2 with respect to the handle. Preferably the key locking mechanism does not prevent opposite (counterclockwise) rotation because of the angles 228*a*, 228*b*.

Counterclockwise rotation 241 of the blade 2 with respect to the handle is prevented by the bearing of the contact surface 9*a* of adjustable stop device 9 against stop surface 15 of the blade 2. Thus, since both clockwise rotation 239 and counterclockwise rotation 241 with respect to the handle is prevented, the blade is prevented from any substantial rotational motion with respect to the handle (substantially) while the key 6 is in the relaxed or locking position. In this context, "substantial" prevention of rotational movement means no rotational movement of a magnitude that would be noticeable during ordinary use of the knife and is preferably less than zero degrees ten minutes of angle (0° 10') and more preferably less than zero degrees zero minutes ten seconds of angle (0° 0' 10").

Figure 6A:
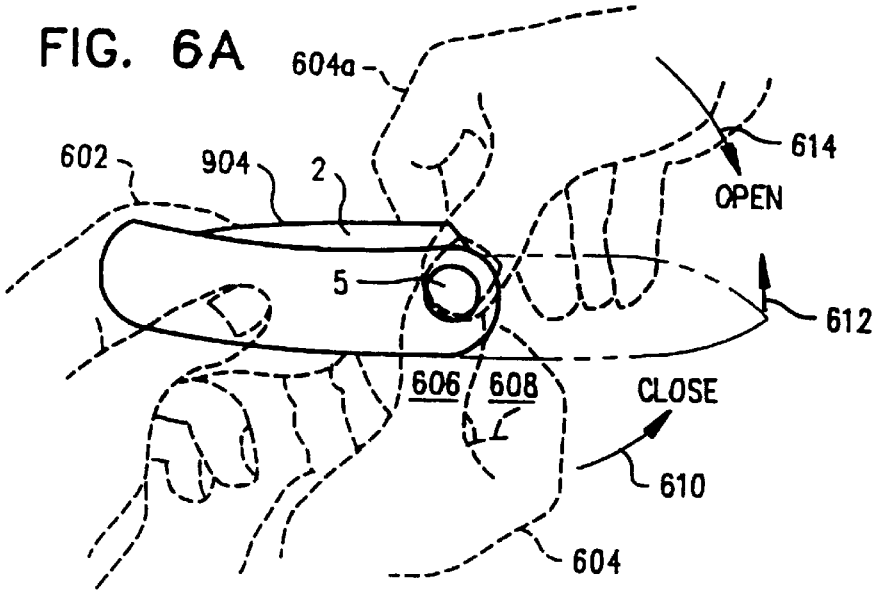
FIG. 6A is a left side elevational view of a knife according to an embodiment of the present invention with the blade in a folded configuration, and showing the extended blade in the phantom with indications in the phantom of a manner of holding and folding and unfolding the blade.
Figure 6B:
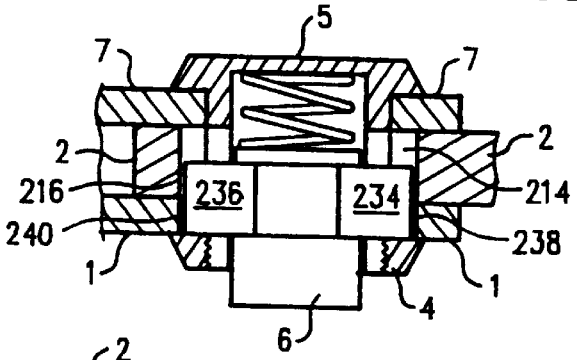
FIG. 6B is a cross-sectional view taken along line 6*b*—6*b* of FIG. 4.
Figure 7:
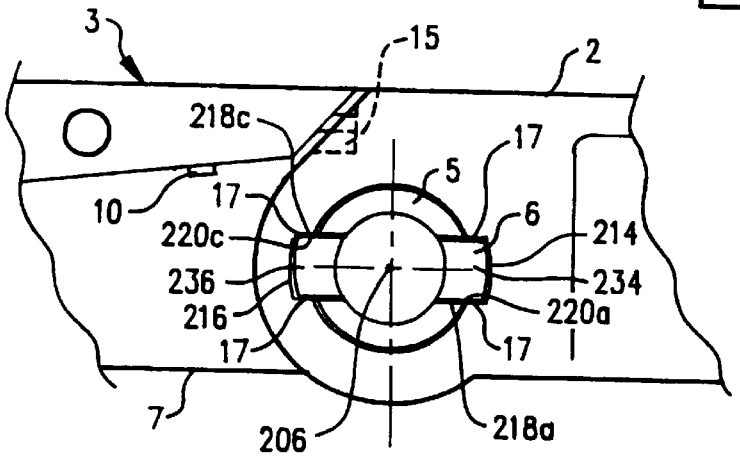
FIG. 7 is a partial side elevational view of the knife of FIG. 5 with the right side blade removed.

FIG. 6A depicts an operation of the knife. In the depicted embodiment, a user grasps the handle, e.g., with the left hand 602. The open position of the blade is shown in FIG. 6A by phantom lines. When it is desired to close the knife, the user grasps the key locking mechanism, e.g. with the right or left hand 604, compressing the key locking mechanism between the thumb 606 and forefinger 608 to move the key 6 to the position depicted in FIG. 8 such that the key devices 234, 236 reside solely within the blade keyway 214, 216 and are clear of the right plate keyway 238, 240. In the depressed configuration, the key contact surfaces 220*a*, 220*c* no longer contact the plate keyway contact surfaces 23*a*, 23*b* and, as a result, clockwise rotation of the key (and thus the blade) is no longer prevented. The user then can rotate the key mechanism in a clockwise direction 239, e.g. by moving the hand 604 in direction 610 (which is shown in FIG. 6A as a counterclockwise movement since FIG. 6A is a view along line-of-sight 252 while FIG. 5 is a view along line-of-sight 254). As the key 6 rotates, contact surfaces 220*c*, 220*a* push against blade keyway surfaces 218*c*, 218*a* respectively, as shown in FIG. 7 thus carrying the blade 2 in a similar movement 612 towards the closed configuration depicted in FIG. 3. Rotation of the key 6 and blade 2 continue until the blade stop surface 232 contacts the stop device 8 as depicted in FIG. 9. Stop device 8 is configured and/or adjusted such that when the blade stop surface 232 contacts the stop device 8, the key 6 will have rotated to a position such that the key contact surfaces 220*b*, 220*d* are substantially aligned with plate keyway contact surfaces 22*a*, 22*b*, allowing the key 6, upon the user releasing pressure between the thumb and forefinger 606, 608, and under the urging of the spring 208, to relax or return to the position situated partially in the plate keyway 238, 240 as depicted in FIG. 6B. Since surfaces 220*b*, 220*d* are inclined at angles 228*b*, 228*a* with respect to planes 224*a*, 224*b* (as described above) the blade 2, when it reaches the closed configuration, has traveled through a rotational angle 902 which is less than 180°. This permits the designer of a knife to select the angle 902 desired for the particular use rather than being constrained to a closed position which is 180° from the open position. This, for example, permits the design of a folding knife which provides the positive locking feature desired but permits the back edge 904 of the blade to more easily protrude above the handle in the closed configuration. providing a rotational angle 902 of less than 180 degrees places fewer constraints on the design of the spacer and, in particular permits the spacer to be provided with a depth 903 which is greater than that possible when the angle 902 is 180 degrees, at least if the knife is designed with a pleasing appearance and without excessive or unnecessary weight. Greater depth 903 for the spacer provides greater stability to the knife, such as better maintenance of the plates in the desired, usually parallel, relationship.

Figure 9:
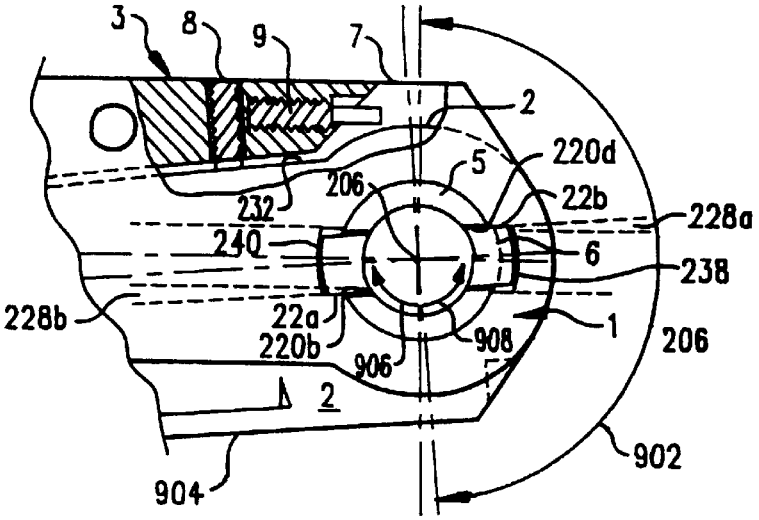
FIG. 9 is a right side elevational view corresponding to the view of FIG. 5 but with the blade in the folded configuration.
Figure 10:
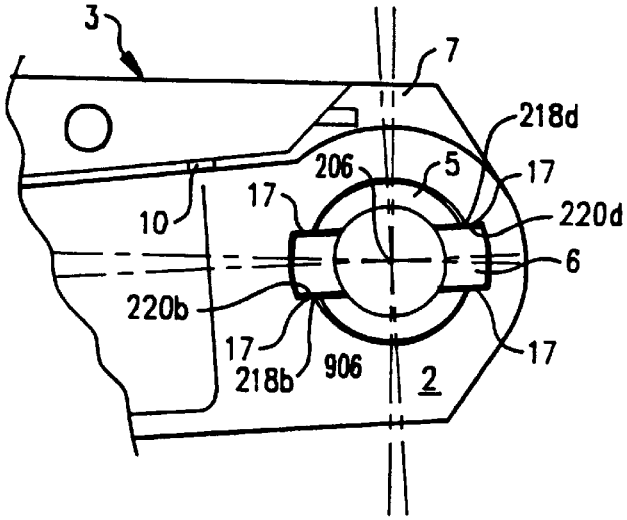
FIG. 10 is a right side elevational view of a knife corresponding to the view of FIG. 9 but with the right side plate removed.

In the closed and locked configuration depicted in FIG. 9 rotation in the clockwise direction 906 is prevented by contact of the stop device 8 with the blade stop surface 232 and rotation in the counterclockwise direction 908 is prevented by contact of key contact surfaces 220*b*, 220*d* with plate keyway contact surfaces 22*a*, 22*b* respectively. Since the key 6 is fitted in the keyway of the blade with relatively close tolerance as depicted in FIG. 10, preventing rotation of the key 6 with respect to the handle also prevents rotation of the blade 2 with respect to the handle in the closed configuration.

Figure 8:
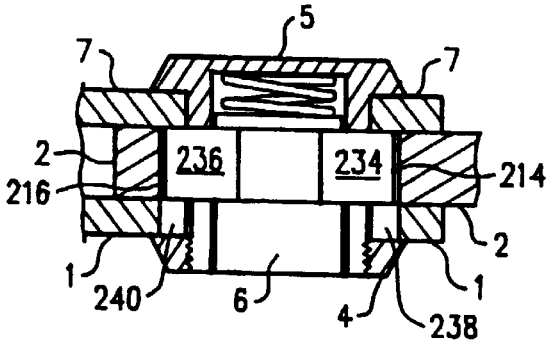
FIG. 8 is a cross-sectional view corresponding to the view of FIG. 6B but with the key device depressed.

When it is desired to open the knife from the closed configuration, the user grasps the key locking mechanism, e.g., as depicted in FIG. 6A compressing the key locking mechanism to move the key 6 from the position depicted in FIG. 6B to the position depicted in FIG. 8 such that keys 234, 236 reside solely within the blade keyway 214, 216 and are clear of the right blade keyway 238, 240. In the depressed configuration, the key contact surfaces 220*b*, 220*d* no longer contact the plate keyway contact surfaces 22*a*, 22*b* and, as a result, counterclockwise rotation (in the view of FIG. 9) of the key (and thus of the blade) is no longer prevented. The user then can rotate the key in a counterclockwise direction 908, e.g. by moving the hand 604*a* in direction 614. As the key 6 rotates, contact surfaces 220*b*, 220*d* push against the blade keyway surfaces 218*b*, 218*d* respectively, as depicted in FIG. 10, thus carrying the blade 2 in a similar movement 614 towards the open configuration depicted in FIG. 4. Rotation of key 6 and blade 2 continue until the blade stop surface 15 contacts the stop device 9 as depicted in FIG. 5. Stop device 9 is configured and/or adjusted such that when the blade stop surface 15 contacts the stop device 9, the key 6 will have rotated to a position such that the key contact surfaces 220*a*, 220*c* are substantially aligned with the plate keyway contact surfaces 23*a*, 23*b*, allowing key 6, upon the user releasing pressure between the thumb and forefinger, 608, 606, and under the urging of spring 208, to relax or return to the position situated partially in the plate keyway 238, 240 as depicted in FIG. 6B. In this opened and locked configuration, depicted in FIG. 5, rotation in the counterclockwise direction 241 is prevented by contact of the stop device 9 with the blade stop surface 15 and rotation in the clockwise direction 239 is prevented by contact of key contact surfaces 220*a*, 220*c* with plate keyway contact surfaces 23*a*, 23*b* respectively. Since the key 6 is fitted in the keyway of the blade with relatively close tolerance 17 as depicted in FIG. 7, preventing rotation of the key 6 with respect to the handle also prevents rotation of the blade 2 with respect to the handle in the open configuration.

Figure 11:
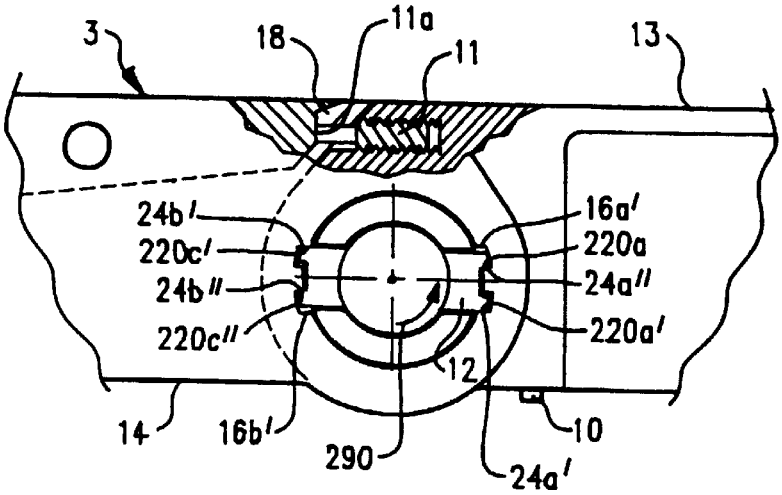
FIG. 11 is a right side elevational view of a knife according to an embodiment of the present invention with the blade extended, partially cut away and with the nut removed.
Figure 12:
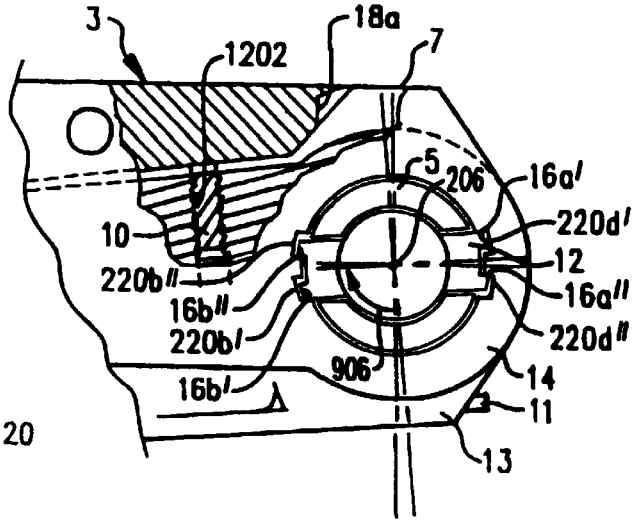
FIG. 12 is a right side elevational view of the knife depicted in FIG. 11 but with the blade in the folded configuration.

FIGS. 11 and 12 depict another embodiment of the invention. In the embodiment of FIGS. 11 and 12, the key 12 is configured to provide more than two effective anti-rotation contact surfaces in the closed position and more than two effective anti-rotation contact surfaces in the open position. Thus, in the embodiment of FIG. 5 the key 6 has four contact surfaces, 220*a*', 220*a*", which contact corresponding plate keyway contact surfaces 24*a*', 24*a*"and also has two further key contact surfaces 220*c*', 220*c*"which abut plate keyway contact surfaces 24*b*', 24*b*"respectively when the blade 13 is in the extended position and the key 12 is in the locking position. As shown in FIG. 12, the key 12 also has four key contact surfaces 220*d*', 220*d*", 220*b*', 220*b*" configured to contact plate keyway contact surfaces 16*a*'16*a*"16*b*', 16*b*"to prevent counterclockwise rotation when the blade 13 is in the closed position. It is believed that by providing additional contact surfaces as depicted in FIGS. 11 and 12, the strength provided for holding the blade in the extended or folded configuration is enhanced.

FIG. 11 also depicts a configuration in which a stop device 11 for preventing counterclockwise rotation when the blade is extended is coupled, preferably adjustable coupled, to the blade 13, rather than being coupled to the handle. The stop device 11 is configured and/or adjusted such that when the blade is in the desired extended position the contact surface 11*a* will contact a stop surface 18*a* formed in a cavity 18 of the handle and preferably, the spacer 3. As depicted in FIG. 12, a stop device 10, preferably adjustable, is coupled to blade 13 and positioned or adjusted to prevent clockwise rotation 906 of the blade 13 when it is in the closed configuration by bearing against a stop surface 1202 of the handle, preferably formed in the spacer 3. Because the side plate keyway contact surfaces are parallel to each other, the configuration of FIGS. 13 and 14 may be used to retrofit an existing handle assembly to permit introduction of a new blade shape.

In the various embodiments described thus far, two different devices are used for preventing rotation in the clockwise direction and counterclockwise direction respectively. For example, in the embodiments of FIGS. 5 and 9, the key and keyway prevent clockwise rotation in the extended configuration and counterclockwise rotation in the folded configuration while the stop devices 8 and 9 prevent counterclockwise rotation in the extended configuration and clockwise rotation in the folded configuration. It is believed preferable according to at least one embodiment of the invention, that integral surfaces of the key and keyway are not used for both clockwise antirotation and counterclockwise antirotation in a given blade configuration, since this is believed to contribute to rotation or play in the locked blade position or other undesirable performance characteristics, at least for normal machining and tolerance parameters.

Figure 13:
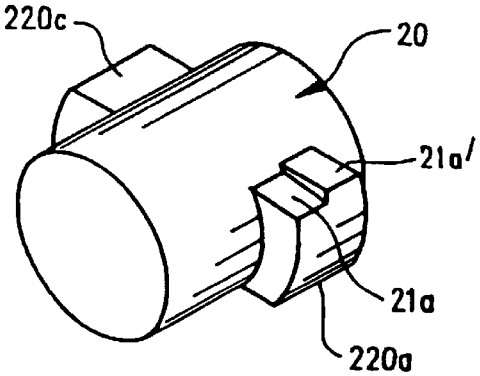
FIG. 13 is a perspective view of a key device according to one embodiment of the present invention.
Figure 14:
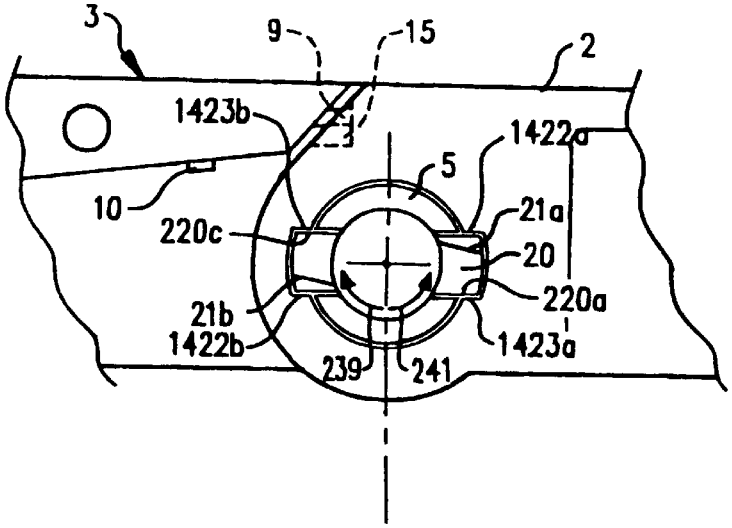
FIG. 14 is a right side elevational view of a knife according to an embodiment of the present invention,. partially cut away, with the nut removed, using the key of FIG. 13.

FIGS. 13 and 14 depict another embodiment of the invention in which the plate keyway surfaces 1422*a*, 1423*a*, 1422*b* are co-planer or parallel with one another rather than be offset at angles 228*a*, 228*b* as depicted in FIG. 2. In this embodiment, the key 20 provides key devices with contact surfaces 21*a*, 21*b* that are offset from adjacent contact surfaces 21*a*', 21*b*'. This is depicted, e.g., in the view of FIG. 13. According to this embodiment, when the blade is in the extended position as depicted in FIG. 14, the operation is similar to that depicted in FIG. 5, i.e., clockwise rotation 239 is prevented by interaction of surfaces 220*a*, 220*c* with keyway contact surfaces 1423*a*, 1423*b* respectively and counterclockwise rotation 241 is prevented by abutment of stop device 9 with stop surface 15. However, when the blade 2 is rotated to the closed position, offset surfaces 21*a*, 21*b* will contact plate keyway contact surfaces 1422*b*, 1422*a* respectively to prevent counterclockwise rotating 241. Although plate keyway contact surfaces 1422*b*, 1422*a* are respectively parallel to keyway contact surfaces 1423*a*, 1423*b*, the angled or offset nature of the surfaces 21*a*, 21*b* permit locating the blade 2 in a folded configuration which is less than 180° rotated from the extended position depicted in FIG. 14.

Figure 15:
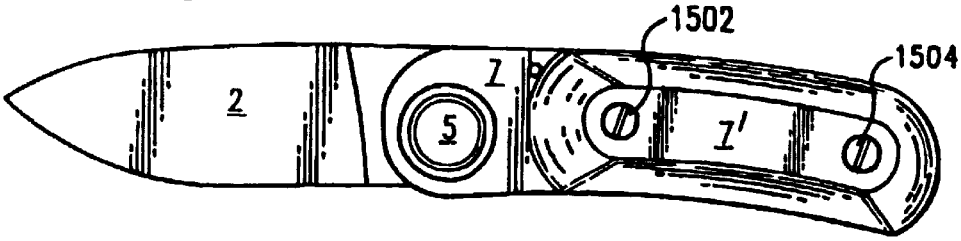
FIG. 15 is a left side elevational view of a knife according to one embodiment of the present invention.

FIG. 15 depicts another embodiment of the invention in which handle plates or scales 7' are positioned on he exterior surfaces of the sideplates 1, 7. In the depicted embodiment, the handle plates (or scales) are held to the sideplate preferably by threaded fastners 1502, 1504 rather than e.g. glue. By making the handle plates removable, it is possible for the user to easily replace or modify the handle plates, e.g. by whittling. A number of materials can be used for the handle plates, including plastic, wood, bone, ceramic, metal, and resin. By making the handle plates removable, this embodiment provides for ease of assembly at the time of manufacture and ease of after-market retrofit, repair, modification or maintenance.

In light of the above description, a number of advantages of the present invention can be seen. The present invention provides a folding knife which achieves secure locking in at least the extended position and, preferably, also a folded condition with substantially no rotation of the blade with respect to the handle when in the locked condition while still providing a device which is relatively easy to design, manufacture, repair and maintain. The invention can have adjustable stops, preferable user-adjustable, to make the device not only easy to manufacture, but also to make the device easy to maintain e.g., to compensate for wear by adjusting set-screws 8, 9. Preferably, the device is ambidextrous, i.e. can be easily operated by using either the right hand or the left hand to depress the key locking mechanism.

The present invention provides for the sheathing of the blade and the handle quickly and safely and for the blade to be quickly made available in a secure and firm manner when unfolded for use. In some embodiments the mechanism controlling the knife blade is configured to avoid inadvertent unlocking. The present knife device is readily operated between its two extreme positions, is safe, simple, accurate and long-lived. Further, the present invention provides the above-described advantages and various other advantages, while being relatively easy and economical to design, manufacture, maintain and repair.

A number of variations and modifications of the present invention can also be used. It is possible to use some aspects of the invention without using other aspects. For example, it is possible to provide a locking knife which is configured to have a blade rotation other than 180° between the extended and folded configuration without providing set screw-type stop devices. It is possible to provide separate anti-rotation devices for clockwise and counterclockwise motion without providing for rotating of the blade via rotating the carrier and key. Although in the depicted embodiments a key and keyway mechanism is used for preventing on in a first rotational direction while stop devices are used for preventing rotation in a second rotational direction, other mechanisms can be used for these purposes than those depicted. A number of different key and keyway shapes can be used, as non-exhaustively illustrated in the embodiments of, e.g., FIG. 5 and the embodiment of FIG. 11. For example, a key and keyway having more or fewer than the depicted two key devices or which has key devices shaped differently than those depicted (e.g. cylindrical, tapering, and the like can be used. Although the key is depicted as being held in place by a carrier and screw-threaded nut, other ways of maintaining a key in a desired area can be provided, including stamping, press fit, flanges and the like. A biasing or urging means other than helical spring 208 can be provided such as a compression spring, a leaf spring, a resiliently deformable plastic or other material and/or hydraulic or pneumatically-forced systems. In addition to a rotational key device, a rotational device with other or additional ways of coupling selectively to the handle can be provided such as a device for radially expanding and compressing against a circumferential surface, a rachet or a cam device. Similarly, a number of stop, preferably adjustable stop, devices can be provided, e.g. as non-exhaustively illustrated in FIGS. 5 and 11. Other types of stop devices could be provided, such as stop devices that are adjustable by a rack and pinion device, a lateral set-screw device, or a cam with respective stop devices being attachable in a number of fashions to either the blade or the handle including coupling via a screw coupling as depicted, or via dovetail or mortise and tenon, pin and hole or other coupling configurations. Although stop surfaces, e.g. stop surface 15, are disclosed as being formed by cut,out portions, they can also be formed as, e.g. pockets or cavities.

The knife according to the present invention could be made out of a number of materials, including metal, plastic, fiberglass, reinforced resins and the like. Preferably, the blade 12 is formed of steel. Preferably, the plates and spacer are formed of steel, aluminum or titanium. Preferably, the carrier, key and nut are formed of stainless steel or carbon steel (preferably plated).

Although the present invention has been described by way of preferred embodiments and certain variations and modifications, other variations and modifications can also be used, the invention being defined by the following claims:

I claim:

1. A knife comprising:

a handle having at least a first opening defining a first axis of rotation;

a blade rotatably coupled to said handle, rotatable about said first axis between extended and non-extended configurations, said blade having a longitudinal axis substantially perpendicular to said first axis;

a key device positionable at least partially in said first opening and moveable from a first position to a second position wherein said key device, in said first position engages a key way in said first opening to substantially prevent rotation of said key device in only a first rotational direction about said first axis with respect to said handle and wherein said key device is coupled to said blade in both said first position and said second position so that said key device rotates with said blade about said first axis; and at least a first stop surface coupled to one of said blade and said handle, positioned to abut a contact surface of the other of said blade and said handle when said blade is in said extended configuration to prevent rotation of said blade with respect to said handle in a second rotational direction opposite to said first rotational direction, said first stop surface being adjustable along an adjustment axis which is substantially parallel to said blade longitudinal axis when said blade is in said extended configuration; wherein said key device includes at least a first planar contact surface which abuts a substantially co-planar keyway surface lying in a first plane when said blade is in said extended configuration; and wherein said handle includes at least a second substantially planar keyway surface which abuts a surface of said key device when said blade is in said non-extended configuration, said second planar surface being non-parallel to said first plane.

2. A knife comprising:

a handle having at least a first opening defining a first axis of rotation;

a handle keyway formed in said handle;

a blade rotatably coupled to said handle, rotatable about said first axis between extended and non-extended configurations, said blade having a longitudinal axis substantially perpendicular to said first axis;

a blade keyway formed in and rotatable with said blade;

a key device positionable at least partially in said first opening and moveable from a first position to a second position wherein said key device, in said first position engages both said handle keyway and said blade keyway in said first opening whereby engagement of said key device with both said handle keyway and said blade keyway acts to substantially prevent rotation of said key device in only a first rotational direction about said first axis with respect to said handle and wherein said key device is coupled to said blade in both said first position and said second position so that said key device rotates with said blade about said first axis; and at least a first stop surface coupled to one of said blade and said handle, positioned to abut a contact surface of the other of said blade and said handle when said blade is in said extended configuration to prevent rotation of said blade with respect to said handle in a second rotational direction opposite to said first rotational direction, said first stop surface being adjustable along an adjustment axis which is substantially parallel to said blade longitudinal axis when said blade is in said extended configuration.

3. A knife as claimed in claim 1 wherein said adjustable stop surface comprises a set screw.

4. A knife as claimed in claim 1 further comprising:

at least a second adjustable stop surface coupled to said blade or said handle positioned to prevent rotation of said blade in one of said first and second rotational directions when said blade is in said non-extended configuration.

5. A knife as claimed in claim 4 wherein both said first and said second adjustable stop surfaces are coupled to said handle.

6. A knife as claimed in claim 4 wherein both said first and said second adjustable stop surfaces are coupled to said blade.

7. A knife as claimed in claim 1 wherein:

said key device defines at least two surfaces for abutting keyway surfaces in said handle when said blade is in said extended configuration and at least two additional surfaces for abutting keyway surfaces in said handle when said blade is in said non-extended configuration.

8. A knife as claimed in claim 1 wherein said key device defines at least four surfaces for abutting keyway surfaces in said handle when said blade is in said extended configuration and at least four additional surfaces for abutting keyway surfaces in said handle when said blade is in said non-extended configuration.

9. A knife, as claimed in claim 1 wherein said key device has at least a first surface and wherein said key device engages said handle keyway by contact of said first surface with a surface of said handle keyway.

10. A knife as claimed in claim 9 wherein said key device includes at least a second surface configured to contact a surface of said blade keyway when said key device is in said first position.

11. A knife as claimed in claim 10 wherein said second surface is non-parallel with said first surface.

12. A knife, as claimed in claim 2, wherein said contact surface is substantially perpendicular to said adjustment axis.

13. A knife comprising:

a handle;

a first keyway means in said handle;

a first key device;

a blade rotatably coupled to said handle, rotatable about a first axis in response to rotation of said first key device, said blade having a longitudinal axis substantially perpendicular to said first axis;

a second keyway means in said blade, and rotatable with said blade;

disengagable means engagable substantially simultaneously with said first keyway means and said second keyway means for substantially preventing rotation of said blade with respect to said handle in only a first rotational direction when said blade is in a first extended position with respect to said handle;

means, different from said disengagable means, defining a stop surface for substantially preventing rotation of said blade with respect to said handle in a second rotational direction, opposite to said first rotational direction, when said blade is in said first extended position, said means defining a stop surface being adjustable to move said stop surface with respect to said key device in a direction along an axis which is substantially parallel to said blade longitudinal axis when said blade is in said extended position.

14. In the environment of a knife having a handle, a blade rotatable about said handle and an activatable locking/unlocking mechanism, a method for unfolding said knife comprising:

rotating said blade about a first axis with respect to said handle through a first angle by rotating said activatable locking/unlocking mechanism:

contacting a first stop surface on said blade with a second stop surface on said handle, at least one of said first and second stop surfaces being adjustable in a direction substantially perpendicular to said first axis, to position said blade in an extended configuration and to substantially prevent rotation of said blade in a first rotational direction;

moving said activatable locking/unlocking mechanism so as to contact a first surface on said activatable locking/unlocking mechanism in abutment with a second surface on said handle to substantially prevent rotation of said blade in only a second rotational direction.

15. A knife comprising:

a handle having a handle opening defining an axis of rotation, a blade having a blade opening, the blade rotatably coupled to the handle and rotatable about the axis of rotation;

a key having a plurality of planar key contact surfaces, a handle keyway in the handle opening having a plurality of corresponding planar handle keyway contact surfaces, and a blade keyway in the blade opening having a plurality of corresponding planar blade keyway contact surfaces, the key movable along an axis parallel to the axis of rotation from a first position with the key engaged in both the handle keyway and the blade keyway to a second position with the key engaged in only the blade keyway, wherein in the first position at least one of the key contact surfaces is offset by an offset angle from its corresponding handle keyway contact surface.

16. The knife of claim 15, wherein an opposing pair of blade keyway contact surfaces lie in parallel planes, and an opposing pair of handle keyway contact surfaces lie in non-parallel planes.

17. The knife of claim 15, further comprising a side-by-side pair of key contact surfaces offset from one another by the offset angle.

18. A knife comprising:

a handle having a handle longitudinal axis and a handle opening defining an axis of rotation, a blade having a cutting edge and a blade opening and defining a blade longitudinal axis, the blade rotatably coupled to the handle and rotatable about the axis of rotation through a closing angle from an extended configuration to a closed configuration, wherein the blade longitudinal axis is substantially aligned with the handle longitudinal axis in the extended configuration, and the cutting edge is substantially within the handle in the closed configuration;

a key having a plurality of planar key contact surfaces, a handle keyway in the handle opening having a plurality of corresponding planar handle keyway contact surfaces, and a blade keyway in the blade opening having a plurality of corresponding planar blade keyway contact surfaces, the key movable along an axis parallel to the axis of rotation from a first position with the key engaged in both the handle keyway and the blade keyway to a second position with the key engaged in only the blade keyway;

wherein in the extended configuration a key contact surface abuts a substantially coplanar corresponding handle keyway contact surface lying in a first plane, and in the closed configuration a handle keyway contact surface abuts a substantially coplanar corresponding key contact surface lying in a second plane, such that the second plane is non-parallel to the first plane.

* * * * *